US005154101A

United States Patent [19]

Wolford et al.

[11] Patent Number: 5,154,101

[45] Date of Patent: Oct. 13, 1992

[54] COMBINATION JAR OR BOTTLE CAP REMOVER AND BAG OPENER

[76] Inventors: Dalton H. Wolford; Elinor B. Wolford, both of P.O. Box 255, Aumsville, Oreg. 97325

[21] Appl. No.: 744,269

[22] Filed: Aug. 13, 1991

[51] Int. Cl.[5] ..... B67B 7/44

[52] U.S. Cl. ..... 81/3.09; 81/3.25; 81/3.4

[58] Field of Search ..... 81/3.07, 3.09, 3.25, 81/3.4

[56] References Cited

U.S. PATENT DOCUMENTS 2,671,362 3/1954 Wilson ..... 81/3.4
3,760,657 9/1973 Muir et al. ..... 81/3.4
4,143,904 8/1964 Yerkes ..... 81/3.4
4,455,894 6/1984 Roberts ..... 81/3.55

FOREIGN PATENT DOCUMENTS 2006738 7/1971 Fed. Rep. of Germany ..... 81/3.4
2556294 6/1977 Fed. Rep. of Germany ..... 81/3.09

*Primary Examiner*—Roscoe V. Parker
*Attorney, Agent, or Firm*—William D. Haffner

[57] ABSTRACT

A combination jar or bottle cap remover and bag opener. This kitchen tool consists essentially of two side bars and a base. One side bar contains a gripping blade for removing caps and the other side bar contains a bag opening device.

8 Claims, 3 Drawing Sheets

COMBINATION JAR OR BOTTLE CAP REMOVER AND BAG OPENER

BACKGROUND OF THE INVENTION

This invention relates generally to kitchen tools. More specifically it relates to jar cap removers and bag openers.

In the past, difficulties have occurred with the removal of caps from jars, bottles, and the like having screw tops. Both large and small caps present removal problems. A more recent problem is that of quickly and safely opening bags. Particularly difficult to open are certain plastic bags.

Many devices have been proposed in the prior art to solve these problems. Some of these devices are described in the following U.S. Patents:

U.S. Pat. No. 4,179,954, issued Dec. 25, 1979 to Whalen.

U.S. Pat. No. 3,760,657, issued Sep. 25, 1973 to Muir, et. al.

U.S Pat. No. 3,751,743, issued Aug. 14, 1973 to Buck. The above listed patents are merely illustrative of the prior art.

SUMMARY OF THE INVENTION

In accordance with the preferred embodiment of the present invention, a combination jar cap removal and bag opening tool is provided for mounting under a kitchen cabinet.

According to the present invention a kitchen tool for removing jar caps and opening bags consists of two bar members and a top plate. One bar member has a serrated blade removably mounted therein for gripping jar caps. The bar members are configured in a V-shape. The other side bar member has a bag opening tool mounted on its exterior surface for opening plastic or other bags. By way of operation, the user of the present invention slides the jar cap between the two side bar members until it firmly engages the teeth of the serrated blade. The cap is then firmly held in place while the jar can be rotated; thereby, separating it from the cap. In operation, the bag opener is first rotated downward to bring its blade into operating position. The top of the bag to be opened is then horizontally passed through the cutting slot; thereby, cleanly cutting of the top of the bag.

It is a primary object of this invention to provide a kitchen tool that efficiently removes jar caps and open bags.

It is a further object of this invention to provide a kitchen tool that can be securely and removably mounted under a kitchen cabinet.

It is another object of this invention to provide a combination jar cap and bag opener tool that has replaceable gripping blades.

It is still another object of this invention to provide a kitchen tool the has the appropriate appearance and construction for use in a household kitchen.

The subject matter of the present invention is particularly pointed out and distinctly claimed in the following description. The invention, however, both as to organization and method of operation together with further advantages and objects thereof may be best understood by reference to the following description taken in conjunction with the accompanying drawings wherein like reference numerals refer to like elements. It is to be understood that this embodiment is not intended to be exhausting nor limiting of the invention but is for the purpose of illustration in order that others skilled in the art of manufacturing may fully understand the invention and principles thereof and the manner of applying it in a particular use so that they may modify it in various ways, each as may best be suited to the conditions of the particular use.

DESCRIPTION OF THE PREFERRED EMBODIMENT

Figure 1:
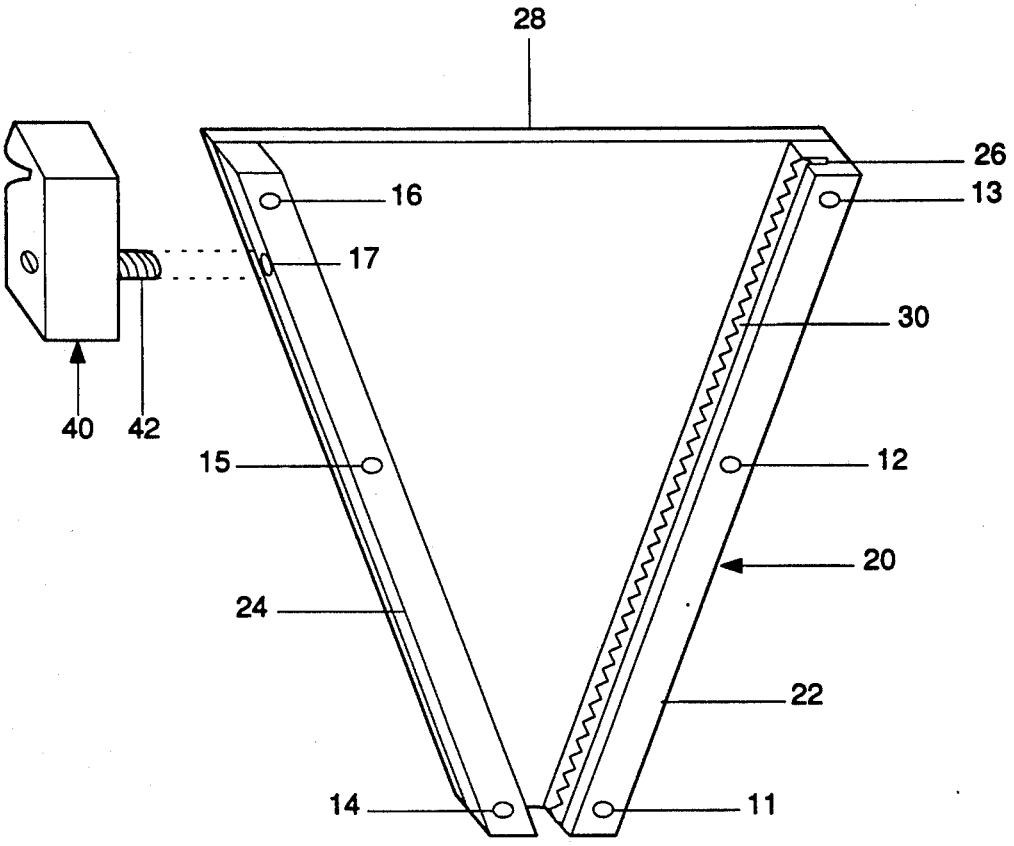
FIG. 1 is a perspective view of the cap removing and bag opening device according to the present invention.
Figure 2:
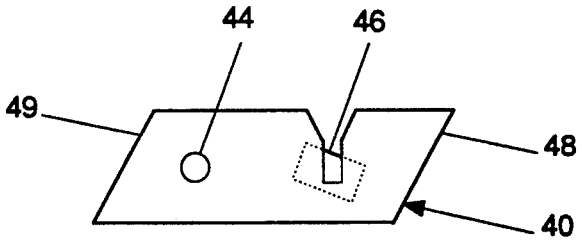
FIG. 2 is a side view of the bag opener.
Figure 3:
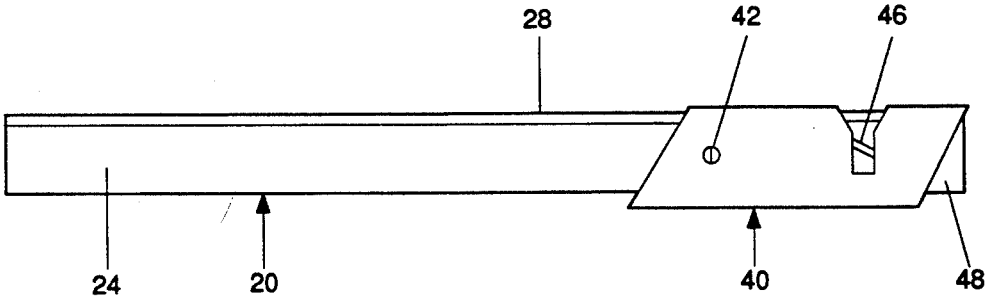
FIG. 3 is another side view showing the bag opener attached to the cap removing portion of the present invention.

Referring now to the drawings, it will be seen that this preferred embodiment of the invention comprises a jar cap removing device 20 and a bag opening device 40 removably attached thereto. Bag opening device 40 is removably and rotatably attached to jar cap removing device 20 with fastener 42.

Jar cap removing device 20 comprises base member 28, side bar member 22, and side bar member 24. The side bar members are configured in a V-shape. Side bar members 22 and 24 are constructed of, preferably, wood. A large number of wood types are suitable for the preferred embodiment of the present invention. One commonly available example thereof is oak. Side bar member 22 has a slot 26 cut along its entire length. Removably mounted in slot 26 is serrated blade 30. Gripping blade 30 is, preferably, a serrated carbon steel blade. An 18-tooth carbon steel hacksaw blade has been found to be very effective and widely available. Multiple blades can be used to increase the gripping action of gripping blade 30. Gripping blade 30 can be easily replaced if it should become worn or broken. Also located in side bar member 22 are mounting holes 11, 12, and 13. Suitable commonly available wood screws can be inserted through these holes to aid in attaching the present invention in its operating location. A typical location would be under a kitchen cabinet. Holes 11 and 13 also align with corresponding holes in gripping blade 30; thereby holding the blade in position when the cap removing device is installed in its operating location. Side bar member 24 has mounting holes 14, 15, and 16 located therein. Suitable wood screws can be inserted in holes 14, 15, and 16 to aid in attaching the cap removing device to its place of operation.

Bag opening device 40 is removably attached to side bar member 24 with fastener 42. Bag opening device 40 is, preferably constructed of wood. A large number of wood types are suitable for the preferred embodiment of the present invention. One commonly available example thereof is oak. Mounted in bag opening device is cutting blade 46. Cutting blade 46 is can be one of various suitable cutting blades. One type of cutting blade found to be useful is a stainless steel mini utility blade. Tungsten steel or carbon steel blades are also suitable. Hole 44 is also located in bag opening device 40. Fastening device 42 is inserted in hole 44 and hole 17 to attach the bag opening device to side bar member 24 of cap remover 20. Any suitable fastening device may be used. A Chicago fastener has been found to be satisfactory.

Figure 4:
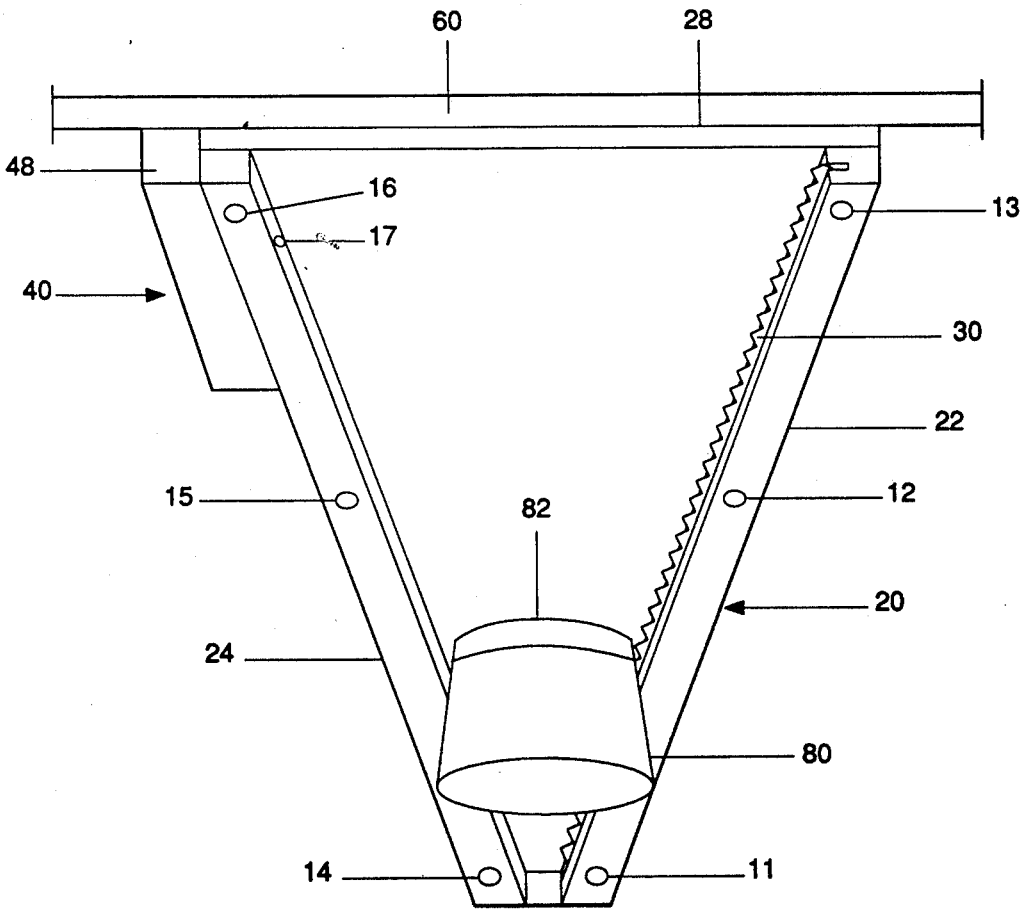
FIG. 4 is a perspective view showing the present invention mounted in its operating position.

FIG. 4 shows the present invention installed in its operating position attached to the bottom of a kitchen cabinet and aligned with cabinet front edge 60. Cap removing device 20 has been mounted under the cabinet with wood screws 11, 12, 13, 14, 15, and 16. In order to remove a jar or bottle cap using the present invention, the user inserts the cap 82 of bottle or jar 80 between side bar members 22 and 24 of cap removing device 20. The cap and bottle is then slid to the rear of cap removing device 20 where cap 82 will engage with the serrated teeth of gripping blade 30. Cap 82 is now firmly held in place. To remove cap 82, grasp bottle 80 and rotate clockwise.

Figure 5:
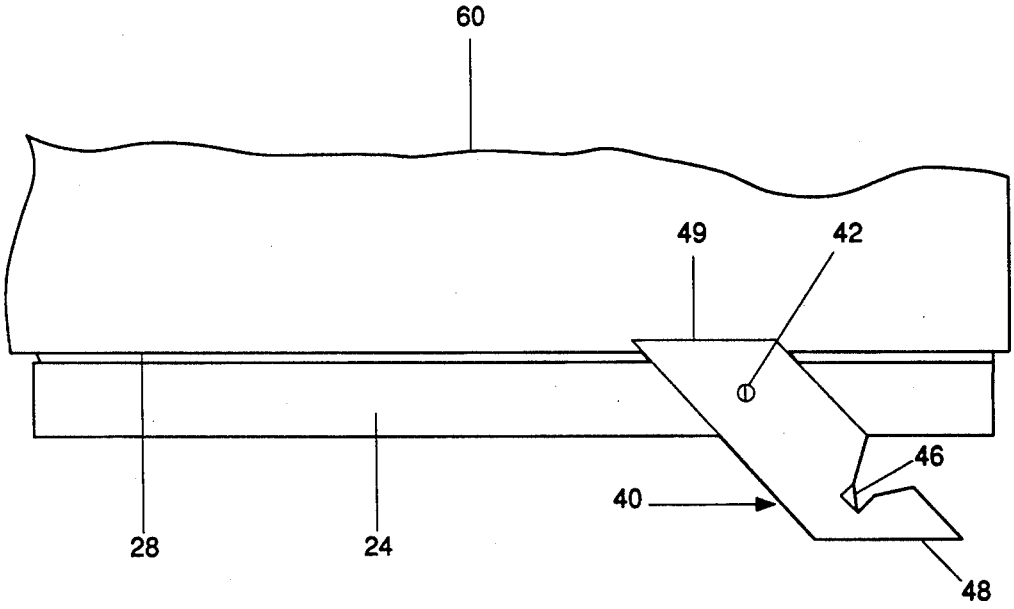
FIG. 5 is a side view of the bag opener rotated to its operating position.

FIG. 5 shows a side view of the present invention installed in its operating position under kitchen cabinet 60. Bag opening device 40 has been installed with fastener 42. Bag opening device 40 has been rotated to its operating position by pushing down on front surface 48. The device is firmly held in this position because its rear surface 49 is in contact with the bottom of cabinet 60 and cannot move. To open a bag, the user grasps the top of the bag and pushes it against blade 46 toward the rear of cap removing device 20. The top of the bag will be cleanly and quickly cut off.

It may be observed in the foregoing specification that such specification is not burdened by the inclusion of large amounts of detail and specific information relative to such matters as construction and the like since all such information is well within the skill of the art. It should be noted that the particular embodiment of the invention which is shown and described herein is intended as merely illustrative and not as restrictive of the invention. Therefore, the appended claims are intended to cover all modifications to the invention which fall within the scope of the foregoing specification.

We claim as our invention:

1. A combination jar or bottle cap removal and bag opening device applicable to the bottom of a horizontal support, comprising:

(a) a first side member attached to said horizontal support, said first side member having serrated cap gripping means removably mounted therein;

(b) a second said member attached to said horizontal support so as to form a substantially V-shaped channel in combination with said first side member and;

(c) bag opening means rotatably attached to said second side member, containing partially exposed cutting blade means, said bag opening means being firmly held in a safe operating position by the bottom surface of said horizontal support.

2. The combination jar or bottle cap removal and bag opening device according to claim 1 wherein serrated cap gripping means consists of one or more hacksaw blades.

3. The combination jar or bottle cap removal and bag opening device according to claim 1 wherein said bag opening means is removably attached to said second side member.

4. The combination or bottle cap removal and bag opening device according to claim 1 wherein said cutting blade means is mounted within a recessed notch thereby protecting the operator thereof from said cutting blade means.

5. The combination jar or bottle cap removal and bag opening device according to claim 1 wherein said bag opening means is capable of being rotated to a safe non-operating position.

6. A combination jar or bottle cap removal and bag opening device applicable to the bottom of a horizontal support, comprising:

(a) a rigid base;

(b) a first side member attached to said rigid base, said first side member having serrated cap gripping means removably mounted therein;

(c) a second side member attached to said rigid base so as to form a substantially V-shaped channel in combination with said first side member and;

(d) bag opening means rotatably attached to said second side member, containing partially exposed cutting blade means mounted within a recessed notch, thereby protecting the operator thereof from said cutting blade means.

7. The combination jar or bottle cap removal and bag opening device according to claim 4 wherein said bag opening means is removably attached to said second side member.

8. The combination jar or bottle cap removal and bag opening device according to claim 4 wherein said bag opening means is firmly held in safe operating or non-operating position by rotation away from or toward said horizontal support.

* * * * *